US010569147B2

(12) United States Patent
Arrington et al.

(10) Patent No.: US 10,569,147 B2
(45) Date of Patent: Feb. 25, 2020

(54) FLEXIBLE IMPLEMENT GRIP WITH RANDOMLY ORIENTED CORD FIBERS

(71) Applicant: Eaton Intelligent Power Limited, Dublin (IE)

(72) Inventors: Andy Allan Arrington, Laurinburg, NC (US); Gregory William Cavill, Pinehurst, NC (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/150,324

(22) Filed: Oct. 3, 2018

(65) Prior Publication Data

US 2019/0118052 A1 Apr. 25, 2019

Related U.S. Application Data

(62) Division of application No. 15/790,179, filed on Oct. 23, 2017, now abandoned.

(51) Int. Cl.

| | |
|---|---|
| ***A63B 53/14*** | (2015.01) |
| ***A63B 60/08*** | (2015.01) |
| ***A63B 49/08*** | (2015.01) |
| ***A63B 53/12*** | (2015.01) |
| *A63B 102/32* | (2015.01) |
| *A63B 102/02* | (2015.01) |

(52) U.S. Cl.

CPC ..... *A63B 53/14* (2013.01); *A63B 49/08* (2013.01); *A63B 53/12* (2013.01); *A63B 60/08* (2015.10); *A63B 2102/02* (2015.10); *A63B 2102/32* (2015.10); *A63B 2209/00* (2013.01)

(58) Field of Classification Search

CPC ..... B32B 27/12; B32B 37/00; B32B 2260/00; B29C 31/08; B29C 2043/3427; B29C 48/2886; B29C 51/145; B29C 59/025; B29C 70/30; B29C 70/305; B29C 70/504; B29C 43/006

USPC ..... 264/299; 473/568; 156/62.2; 273/81; 428/138

See application file for complete search history.

(56) References Cited

U.S. PATENT DOCUMENTS

| | | | |
|---|---|---|---|
| 3,969,568 | A | 7/1976 | Sperley |
| 4,098,506 | A | 7/1978 | Gaiser |
| 4,261,567 | A | 4/1981 | Uffindell |
| 5,467,984 | A | 11/1995 | Veux |
| 5,607,745 | A | 3/1997 | Ogden |
| 5,714,229 | A | 2/1998 | Ogden |
| 6,663,500 | B2 | 12/2003 | Huang |
| 8,413,262 | B2 | 4/2013 | Vito |

(Continued)

*Primary Examiner* — Matthew J Daniels
*Assistant Examiner* — Yunju Kim
(74) *Attorney, Agent, or Firm* — Fay Sharpe LLP

(57) ABSTRACT

A flexible grip for implements to be manually swung with speed and force, particularly golf clubs is disclosed. The grip is formed of elastomeric material die cut into patterns from uncured sheet stock. Discrete non-woven fibers of material having desired moisture absorbency are dispensed in random orientation onto the uncured sheet stock and embedded by rolling into the sheet stock. The pattern sheet stock, with embedded fibers is wrapped onto a mandrel which is inserted into a pre-mold, compressed thereon, removed and transferred to a compression mold, and cured. The mandrel is removed from the mold and the cured grip removed from the mandrel and installed onto the implement grip.

8 Claims, 6 Drawing Sheets

(56) References Cited

U.S. PATENT DOCUMENTS

| | | | | |
|---|---|---|---|---|
| 2003/0148836 | A1 | 8/2003 | Falone | |
| 2014/0182766 | A1* | 7/2014 | Rochefort | B29C 43/26 156/62.2 |
| 2015/0126299 | A1* | 5/2015 | Lamkin | A63B 53/14 473/298 |
| 2016/0151984 | A1 | 6/2016 | Miyao | |

* cited by examiner

FLEXIBLE IMPLEMENT GRIP WITH RANDOMLY ORIENTED CORD FIBERS

This application is a divisional of U.S. application Ser. No. 15/790,179 filed Oct. 23, 2017.

BACKGROUND

The present disclosure relates to flexible grips for use on implements to be moved or swung with speed and force such as for axes, hatchets, hammers, and sporting implements such as tennis racquets and golf clubs. The present disclosure particularly relates to flexible grips for golf clubs in which molded elastomer has been employed in widespread use for golf club grips because of the flexibility or "feel" of the elastomeric surface which has proven to be robust in service and to provide a desired level of gripability. It also been the practice in the manufacture of flexible grips for golf clubs to embed a layer of woven fabric such as woven cotton fabric having a fine or tight mesh into the outer or surface layer of the flexible grip. An example of such woven fabric is shown in FIG. 1. This woven cotton fabric has been calandered into the uncured sheet stock prior to insertion into the mold for curing. However, this has resulted in, upon molding, a layer or film of the elastomer covering the outer surface layer of the grip and has required buffing away of the outer film of elastomer in order to expose the surface of the cotton fabric on the surface of the grip.

One of the advantages of having exposed cotton fabric on the surface of the grip has been found to be that the cotton absorbs moisture and thus enhances the user's grip on the club. However, flexible golf club grips employing the woven cotton fabric have a distinct appearance on the surface once the cotton fabric is exposed; and, it is difficult to provide any variation, uniqueness or aesthetic nuances to the appearance of such a grip. The texture is fixed by the weave of the fabric and cannot be varied without changing the woven material.

Although there has been found to be some advantage in providing woven cotton fabric in the surface layer of a flexible golf club grip, this has resulted in additional manufacturing costs and thus is considered somewhat disadvantageous. Furthermore, the employment of the woven fabric renders the cured grip somewhat harder or stiffer.

Accordingly, it has long been desired to provide a way or means of enhancing the gripability of a flexible golf club grip, or other implement grip of the type where the implement is swung with speed and force, in a manner which provides for maintaining the overall softness or flexibility of the elastomer throughout and yet provides enhanced gripability.

BRIEF DESCRIPTION

The present disclosure describes a unique construction for and method of making a flexible elastomeric grip employable for implements such as hammers, axes, hatchets, tennis racquets, and particularly golf clubs. The disclosed flexible grip provides desirable surface characteristics for gripability by the employment of non-woven randomly oriented fibrous material therein and also provides for maintaining the desired softness or durometer in the outer region and surface of the grip.

The flexible elastomeric grip of the present disclosure is manufactured by disposing discrete non-woven randomly oriented fibers of suitable material, having desired moisture absorbency, onto the surface of uncured elastomer in die cut sheet forms. The uncured die cut sheet is coated with a coating of adhesive/solvent material prior to the disposition of the fibers on the surface of the sheet stock; and, the adhesive becomes fugitive upon curing. The fibers are then embedded in the uncured sheet forms which are then wrapped on a mandrel, placed in a mold, and compressed to the desired shape for the grip; and, the elastomer cured. Prior to wrapping the uncured die cut sheet upon the mandrel, the die cut sheet with the fibers disposed on the surface thereof is subjected to pressure, such as by a roller, which forces the discrete random fibers into the surface of the uncured die cut sheet stock. Upon completion of the curing, the mandrel and cured elastomeric grip thereon are removed from the mold and the mandrel removed from the grip to form a tubular flexible grip. Thus, the molded flexible grip has randomly oriented fibers disposed in the outer layer thereof and exposed upon the surface to provide the enhanced gripability without the need for buffing to remove any of the cured elastomer to expose the fibers after removal from the curing mold.

In the present practice, it has been found satisfactory to form the grip of the present disclosure of elastomeric material for the outer layer having a hardness in the range of 45-55 on the Shore "A" scale. In one version, the discrete fibers have length in the range of 12 to 38 millimeters; and, may be formed of materials such as cotton, polyester material, polyamide polymeric, or other material having suitable desired moisture absorbency. In the present practice, the discrete fibers in the disclosed version may have a thickness in the range of 0.4 to 1.3 millimeters. In the present practice, it has been found satisfactory to have the fibers disposed in the elastomeric material with a density in the range of 1 to 10 fibers per cubic centimeter. Also, in the present practice, the fibers may be disposed in the elastomeric material to a depth in the range of 0 to 2 millimeters from the outer surface.

DETAILED DESCRIPTION

Figure 1:
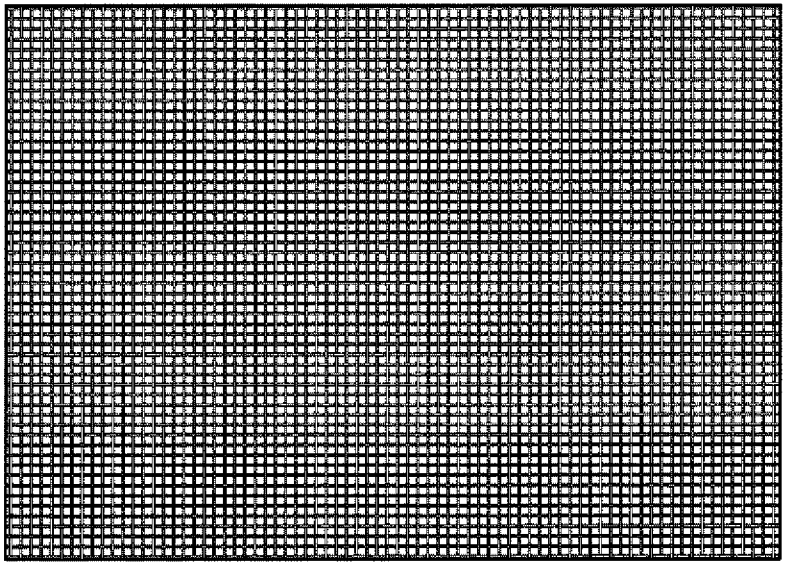
Fig.1 PRIOR ART
FIG. 1 is a photo of typical woven cotton fabric employed in a flexible grip for a golf club as used in the prior art.
Figure 2:
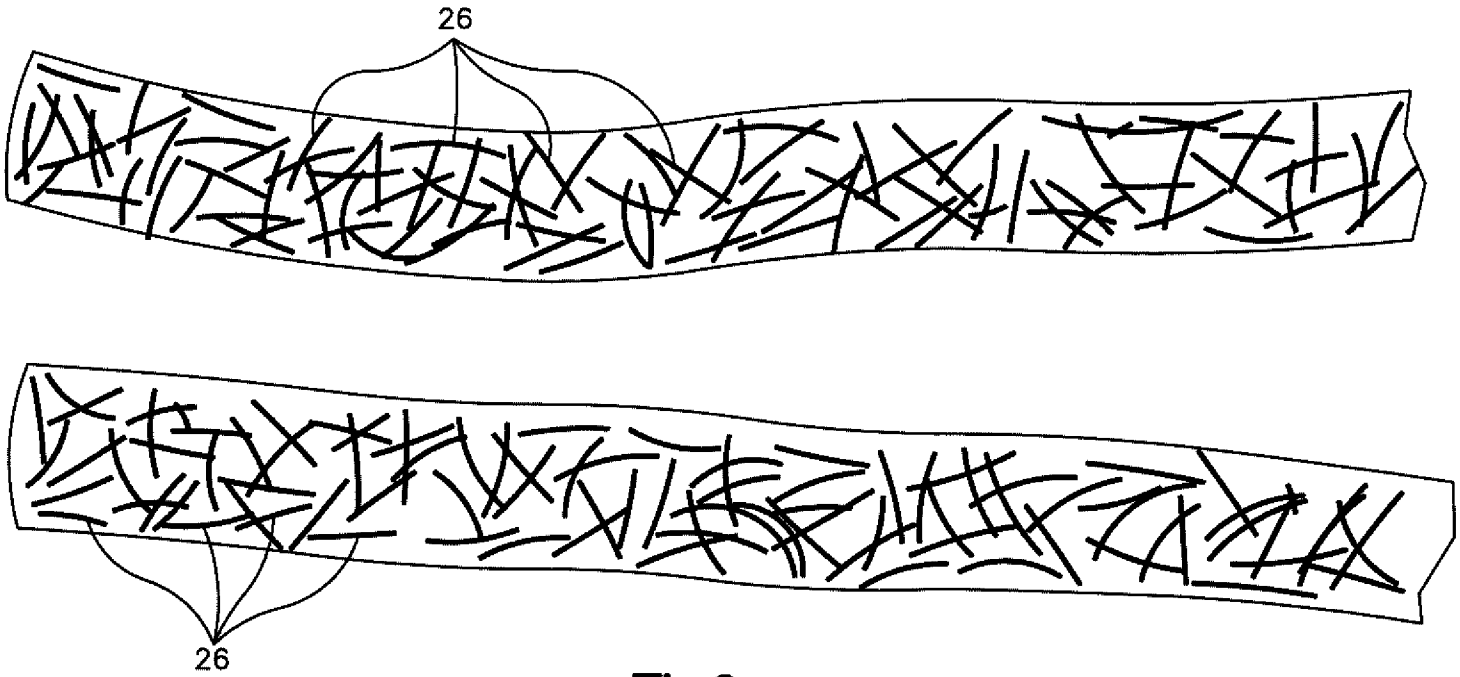
FIG. 2 shows two enlarged views of a portion of the surface of a flexible grip in accordance with the present disclosure with the lower view showing fibers in a slightly greater density.
Figure 3:
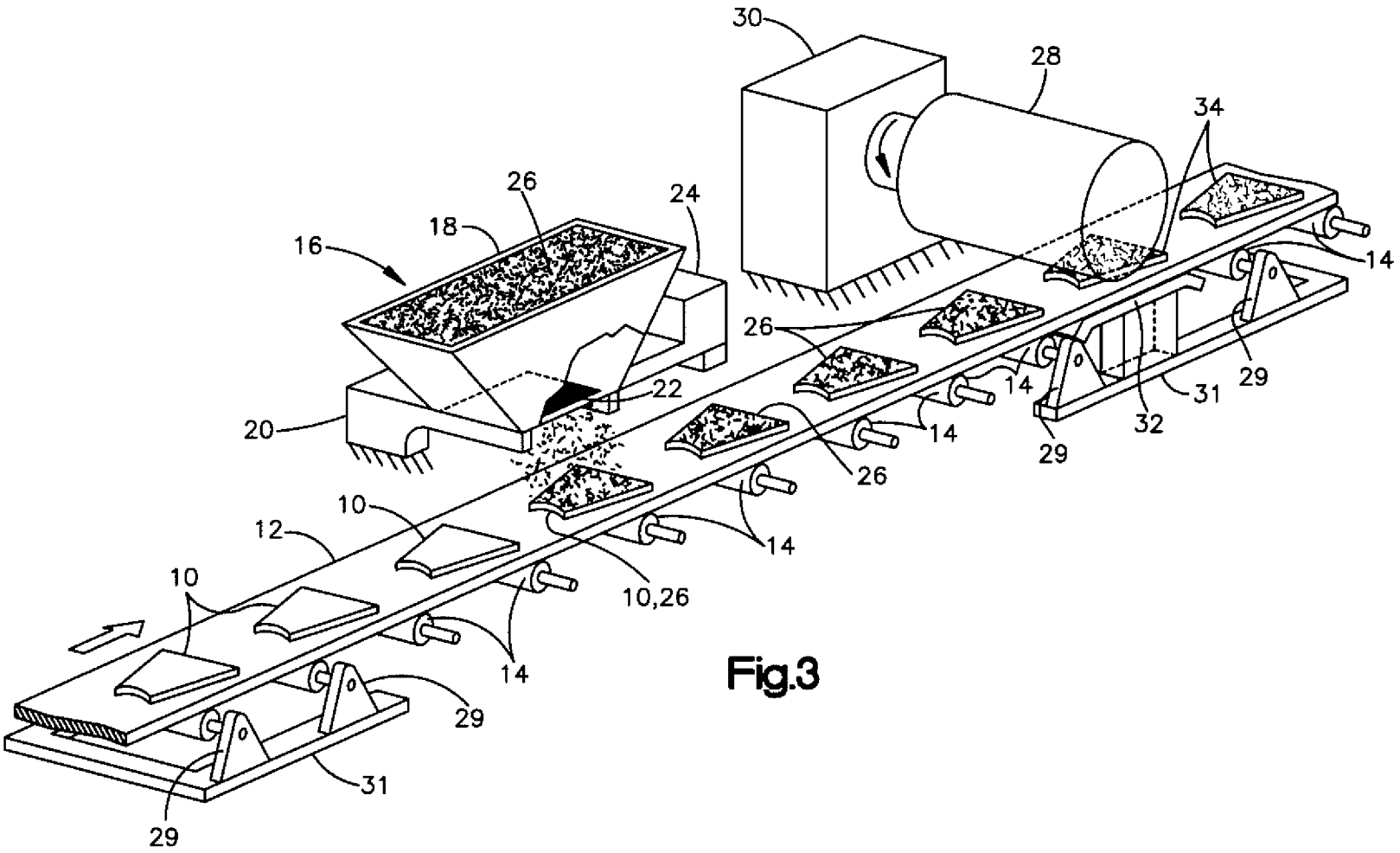
FIG. 3 is a pictorial illustration of the equipment employed for fabricating the die cut sheet stock in preparation for wrapping on a mandrel.
Figure 4:
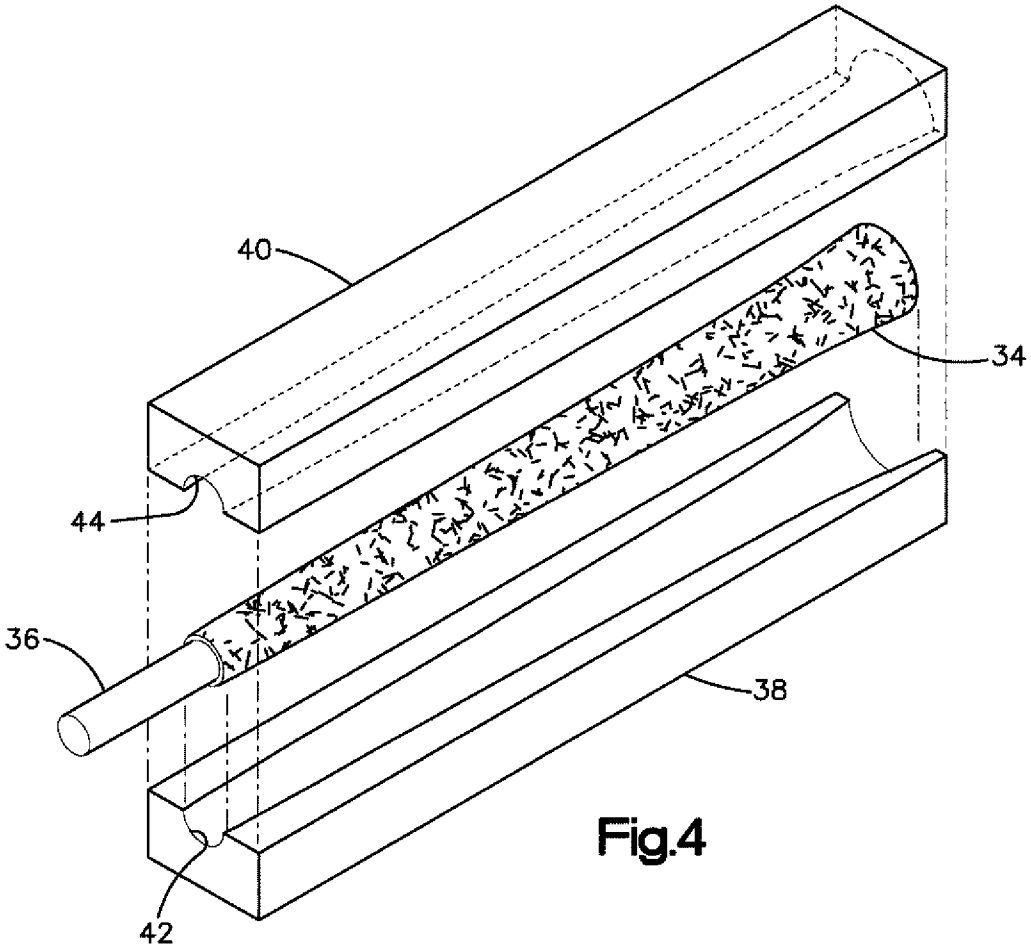
FIG. 4 is an exploded view of a compression mold showing the uncured elastomer with fibers thereon wrapped on a mandrel prior to insertion in the mold for curing.
Figure 5:
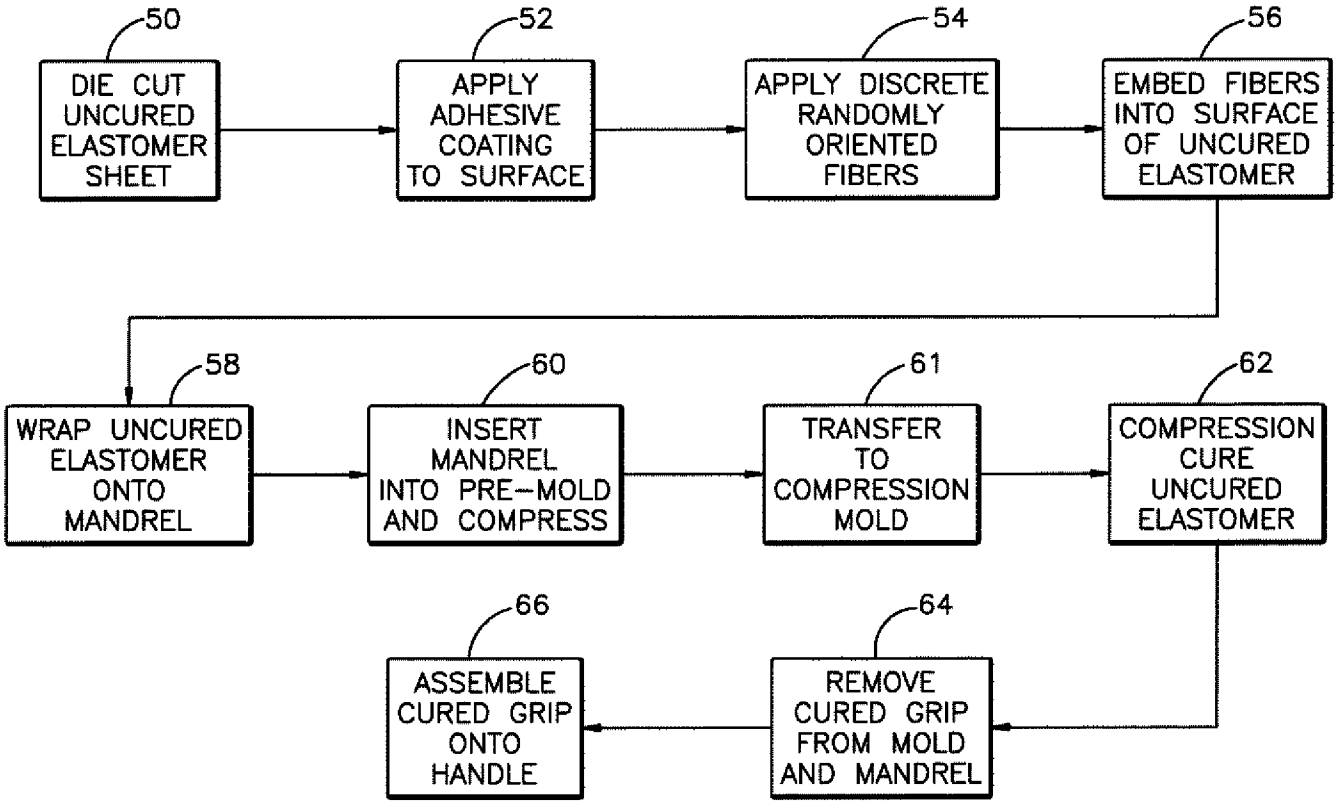
FIG. 5 is a block view diagram of the process for producing the flexible grip of the present disclosure.

Referring to FIGS. 3, 4, and 5, the elastomeric sheet stock for making the grip of the present disclosure is shown as die cut into desired form as denoted by reference numeral 10 in FIG. 3. In the present practice, it has been found satisfactory to form the sheet stock of elastomeric material having a durometer hardness in the range of 33-57 on the Shore "A"

scale. Elastomeric material having this durometer has been found to provide the desired "feel" or gripability, i.e., "traction" and "tack", for use in implements of the type described hereinabove. The die cut sheet pieces 10 are intended to form the outer surface of the grip; however, it will be understood, as is known in the art of flexible grips, that plural layers of die cut elastomeric sheet may be employed in the fabrication of the grip wherein the layers employed interiorly or beneath the surface layer have a durometer hardness somewhat greater than that of the outer surface layer (can be reversed). The die cut sheet stock patterns are disposed in spaced arrangement on a conveyor 12 which is supported by rollers 14 which are each journaled in bearing block 29 supported by frame 31. The conveyor 12 is moved in a right-ward direction in FIG. 3 as indicated by the black arrow by a suitable motorized drive (not shown). As the die cut sheet pieces move right-ward, they pass under a dispenser, indicated generally at 16, which is operable to dispense discrete fibers onto the surface of the die cut sheet stock 10 in a randomly oriented manner.

The dispenser 16 includes a hopper 18 supported by suitable framework or supporting structure 20; and, the hopper 18 has a screen or mesh 22 of a desired porosity disposed over the lower open end thereof. The screen is connected to a motorized vibrator or shaker 24 which is operably connected to vibrate or shake the screen 22. The hopper is filled with the discrete fibers 26.

The dispenser is operated such that when a die cut sheet 10 passes directly beneath the screen 22, the discrete fibers are dispensed onto the surface of the die cut sheet 10. As the conveyor 12 continues its movement, the sheet stock with the discrete fibers deposited thereon, as denoted by reference numeral 26 in FIG. 3, is advanced right-ward to pass under a compression roller 28 which is disposed over the conveyor at a desired station by motor drive unit 30. A support or slipper plate 32 mounted on frame 31 is provided under the conveyor in the region at the station of roller 28 therealong so as to provide support for the conveyor and enable the roller to force the discrete fibers on the sheet stock 26 into the elastomeric material to produce an embedded die cut sheet denoted by reference numeral 34 which is then removed from the conveyor and further processed as will hereinafter been described.

Referring to FIG. 4, the fiber-embedded die cut stock 34 is shown as wrapped on a suitable mandrel 36 in preparation for molding. In the illustrated version, the mandrel has a circular transverse section, as is typically that of a golf club shaft, where the grip is intended as for use on a golf club. However, it will be understood that where the grip is intended for use on other implements such as hammers or tennis racquets, the mandrel 46 may have alternative transverse configurations as for example, elliptical, oval, "D"-shaped, square, rectangular, or a polygonal configuration. The mandrel 36, with the fiber-embedded die cut sheet stock 34 wrapped thereon, is then placed in a pre-mold comprising a lower section 38 and an upper section 40, each having one half of a grip-forming cavity therein as denoted respectively by reference numerals 42, 44. The upper and lower halves of the pre-mold 42, 44 are then clamped together to prove compression of the embedded sheet stock onto the mandrel. The assembled pre-mold is clamped together by any suitable expedient (not shown). After a suitable time period has past the pre-mold is opened and the mandrel with pre-molded die cuts is transferred to a compression mold (not shown), similar to the pre-mold, which is heated to effect the desired curing or vulcanization of the elastomeric material to form an assembled flexible grip.

Referring to FIG. 5, the sequence of the method of fabricating the grip with the present disclosure is illustrated in block flow diagram, wherein the uncured elastomeric sheet is die cut to the desired blank or pattern shape at step 50; and, the adhesive coating is applied to the surface at step 52. The die cut sheet stock with adhesive applied is then coated with discrete fibers in a randomly oriented manner at step 54; and, the fibers coated in step 54 are then embedded into the surface of the elastomer at step 56. In the present practice, the embedding is performed by the roller 28.

The die cut sheet stock is then wrapped onto a mandrel and at step 58, and the mandrel and sheet stock are inserted into a pre-mold at step 60 and the mold is clamped to provide compression; and, then the mandrel and uncured elastomer are transferred to a compression mold at step 61 and the elastomer cured in the mold at step 62. Upon completion of the vulcanization or curing, the mold is opened, and the cured grip and mandrel are removed from the mold at step 64; and, the mandrel is then removed from the grip to enable the completed grip to be assembled onto the handle of the implement at step 66.

In the present practice, it has been found satisfactory to employ discrete fibers having a length in the range of 12 to 38 millimeters; and, the fibers may be formed of one of cotton, polyester material, polyamide, polymeric material, natural or other material having the desired suitable moisture absorbency; and, the fibers may have a thickness in the range of 0.4 to 1.3 millimeters and have a length in the range of 12 to 38 millimeters. It has been found advantageous in the present practice to embed the fibers into the elastomeric material to a depth in the range of 0 to 2 millimeters from the outer surface. In the present practice, the adhesive/solvent applied to the uncured die cut sheet stock 10 is any suitable adhesive which will become fugitive upon the curing in the mold. In the present practice, it has been found satisfactory to provide the discrete randomly oriented fibers in the elastomer so as to provide a density thereof in the range of 1 to 10 fibers per cubic centimeter. However, other fiber densities may be employed if desired to provide particular surface appearance or effect.

Figure 6:
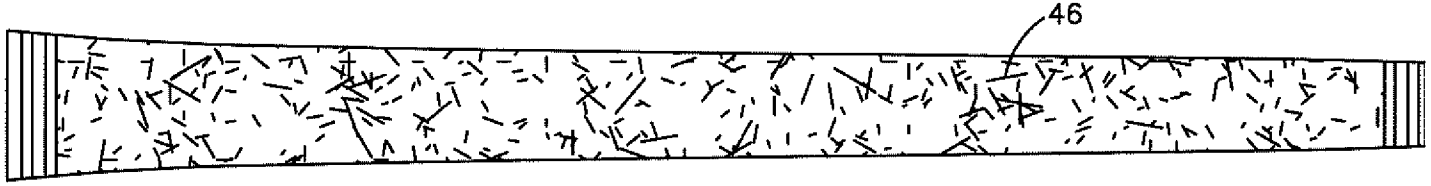
FIG. 6 is a photograph of a version of the completed flexible grip having a slight or relatively low density of discrete fibers embedded therein.

Referring to FIG. 6, a completed grip in accordance with the present disclosure is shown with the discrete fibers 46 exposed on the surface thereof with a minimal or relatively light density.

Figure 7:
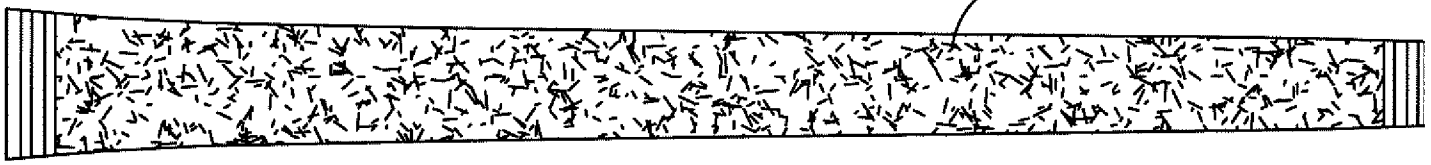
FIG. 7 is a view similar to FIG. 6 of a flexible grip of the present disclosure having a greater density of discrete fibers embedded therein than the version of FIG. 6.

Referring to FIG. 7, another version of the flexible grip of the present disclosure is illustrated wherein the density of the discrete fibers 48 on the surface thereof is significantly greater or increased from that of the density shown in FIG. 6.

The present disclosure thus describes a flexible implement grip, particularly useful for golf clubs, which provides enhanced surface gripability, i.e., "traction", "tack", and "feel" by employing (non-woven) discrete randomly oriented fibers on the surface thereof which provide for enhanced gripability and moisture absorbency.

The exemplary embodiment has been described and illustrated with reference to the drawings. Obviously, modifications and alterations will occur to others upon reading and understanding the preceding detailed description. It is intended that the exemplary embodiment be construed as including all such modifications and alterations insofar as they come within the scope of the appended claims or the equivalents thereof.

The invention claimed is:

1. A method of making a flexible grip for a golf club shaft comprising:

(a) forming a layer of uncured elastomer to a desired configuration;

(b) applying a coating of adhesive to a surface of the layer of uncured elastomer;

(c) applying discrete randomly oriented fibers having a thickness in the range 0.4 to 1.3 mm and length in the range 12 to 38 mm to the adhesive coating in a predetermined surface density;

(d) embedding the fibers into the surface of the uncured elastomer;

(e) disposing the layer into a mold and curing the layer into a generally tubular grip configuration with the fibers adjacent the outer surface; and (f) removing the cured grip from the mold and applying the grip to the handle golf club shaft.

2. The method of claim 1, wherein the embedding includes forcing the fibers into the surface of the uncured elastomer with a roller.

3. The method of claim 1, wherein applying discrete randomly oriented fibers includes one of (i) spraying, (ii) screening, and (iii) gravity dispersing.

4. The method of claim 1, wherein embedding includes embedding the fibers to a depth in the range of 0 to 2 millimeters from the surface of the uncured layer.

5. The method of claim 1, wherein applying discrete randomly oriented fibers includes applying such fibers of material of one of (i) cotton, (ii) polyester, (iii) polyamide, and (iv) natural material.

6. The method of claim 1, wherein disposing in a mold includes wrapping the layer of uncured elastomer onto a mandrel; and, removing the cured grip includes removing from the mandrel.

7. The method of claim 1, wherein applying discrete randomly oriented fibers includes applying fibers formed of cotton material.

8. The method of claim 1, wherein applying discrete randomly oriented fibers includes gravity dispensing.

* * * * *